US008844442B2

(12) United States Patent
Palmatier

(10) Patent No.: US 8,844,442 B2
(45) Date of Patent: Sep. 30, 2014

(54) METHOD FOR ASSEMBLING PRINTED PRODUCTS

(71) Applicant: Goss International Americas, Inc., Durham, NH (US)

(72) Inventor: Roland Thomas Palmatier, Durham, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/916,974

(22) Filed: Jun. 13, 2013

(65) Prior Publication Data

US 2013/0276655 A1 Oct. 24, 2013

Related U.S. Application Data

(60) Continuation of application No. 10/975,614, filed on Oct. 28, 2004, now abandoned, which is a division of application No. 09/717,481, filed on Nov. 21, 2000, now Pat. No. 6,827,012.

(51) Int. Cl.

| | |
|---|---|
| ***B41F 33/00*** | (2006.01) |
| ***B41F 16/00*** | (2006.01) |
| ***B65H 39/075*** | (2006.01) |
| ***B65H 45/28*** | (2006.01) |
| ***B65H 45/22*** | (2006.01) |

(52) U.S. Cl.

CPC ..... *B41F 16/0006* (2013.01); *B65H 39/075* (2013.01); *B65H 45/28* (2013.01); *B65H 45/22* (2013.01)

USPC ..... 101/483; 101/227; 101/484

(58) Field of Classification Search

USPC ..... 101/216, 219, 226, 227, 228, 288, 483, 101/484

See application file for complete search history.

(56) References Cited

U.S. PATENT DOCUMENTS

| | | | | |
|---|---|---|---|---|
| 2,324,834 | A * | 7/1943 | Gurwick | 270/18 |
| 5,441,567 | A * | 8/1995 | Umise et al. | 118/669 |
| 6,041,707 | A * | 3/2000 | Petersen et al. | 101/232 |
| 6,746,164 | B1 * | 6/2004 | Albright et al. | 400/582 |

FOREIGN PATENT DOCUMENTS

| | | | |
|---|---|---|---|
| JP | 04185492 | * | 7/1992 |

* cited by examiner

*Primary Examiner* — Ren Yan

(74) *Attorney, Agent, or Firm* — Davidson, Davidson & Kappel, LLC

(57) ABSTRACT

A method for printing which includes the steps of: printing a web of material so as to define a printed web; winding the printed web onto at least one roll; cutting the printed web so as to define at least one printed roll; transporting the at least one printed roll in rolled form to a folder separate from a printing press; and processing the at least one printed roll in the folder into a finished printed product.

10 Claims, 6 Drawing Sheets

METHOD FOR ASSEMBLING PRINTED PRODUCTS

CROSS-REFERENCE TO RELATED APPLICATIONS

This application is a continuation of U.S. patent application Ser. No. 10/975,614, filed Oct. 28, 2004, which is divisional of U.S. patent application Ser. No. 09/717,481, filed on Nov. 21, 2000, both of which are incorporated by reference herein.

BACKGROUND OF THE INVENTION

The present invention relates generally to a web printing process and more particularly to a method and device for printing a web and folding and assembling the printed web into printed products.

Conventional web printing presses generally print a web of paper in a printing press, the web then being fed directly from the printing press through a drier to a folder. The web is then folded and cut in a folder connected to the printing press so as to form signatures, which may be stored and later collected in a bindery with other signatures to form a final printed product. Folders are complicated and often are the speed limiting component of the printing press.

One known printing process not requiring a folder is roll-to-roll printing. Roll-to-roll printing occurs when a web of material wound in a roll is unwound and printed in a printing process and then wound to a finishing roll. Roll-to-roll printing is known for example to prepare wallpaper, which does not require a folding or assembly process. The rolled and printed wallpaper may then be cut manually to size.

U.S. Pat. No. 4,410,122 purports to disclose an apparatus for manufacturing paper rolls using width-wise control of a web material. The apparatus has a bar structure having resiliently bendable beam means for effecting a primary bowed adjustment. A set of side-by-side independent but cooperative wrap area members are carried by the beam means and are adapted to be individually selectively adjustable relative to the beam means to effect secondary adjustments. A slitter divides a web passing through the device longitudinally into strips.

The '122 patent does not disclose any printing device for printing a web, and is not related to printing processes. Prior to the slitting, no printing is performed on the web.

U.S. Pat. No. 6,041,707 purports to disclose a web-fed rotary printing machine having a plurality of directly adjacent printing units arranged in-line. Below the printing units are winding devices for holding float-mounted winding rolls, which can be used either as a winding device or an unwinding device. The winding rolls accept a printed web of material. A first winding device 15 is used as an unwinding device, so that a web to be printed is unwound from the winding roll and runs through the printing units. The printed web is then guided by a web edge control device to a last winding device 18, where the printed web is wound. Two other winding devices can serve as winding-up devices. The apparatus further provides a roll storage device and conveyance system that operatively connects the roll storage device with the winding device. A folder is arranged downstream of the printing units, in a web-feed direction. A dryer is included after the printing to dry the printed material.

The method and device of the '707 patent has the disadvantage that the wound-up rolls are full width. The device is thus limited in the combination of images and types of products which may be assembled. Assembly of different sections to form a final product is complicated and limited.

BRIEF SUMMARY OF THE INVENTION

An object of the present invention is to provide a method and device for permitting a more reliable and flexible overall printing process. An alternate or additional object of the present invention is to improve electro-mechanical reliability of an overall printing method. Yet another object of the present invention is to provide an efficient and cost-effective method for assembling a final printed product.

The present invention provides a printing device including a roll-to roll printing press for forming a plurality of printed rolls, and a separate assembly device, the assembly device having roll unwinding devices separate from the printing press, a first folder accepting at least one first web from the roll unwinding devices and forming first signatures, and a second folder accepting at least one second web from the roll unwinding devices and forming second signatures.

By providing an assembly device for the printed rolls separate from the printing press, the problems associated with folders can be decoupled from the printing process. Moreover, a wide variety of formats for the final products may be accomplished in the assembly device according to the present invention.

Preferably, the printing press includes a slitter for slitting the web into a plurality of ribbons, the ribbons being wound to form the plurality of printed rolls.

Wide web widths thus can be printed, with the web being slit into narrower ribbons. The narrow resulting rolls can then be more easily assembled in the assembly device.

The present invention also provides a method for printing comprising the steps of printing a web of material in a printing press so as to define a printed web, winding the printed web onto at least one roll, cutting the printed web so as to define at least one printed roll, transporting the at least one printed roll to an assembly device located separately from the printing press, and folding and cutting the at least one printed roll in the assembly device.

Preferably, the transporting is performed via an automated buffer. By providing that the printed rolls may be transported, a folder located in the assembly device need not be directly at the printing press. Although preferably the assembly device is located next to the automated buffer, customers or print shops also could have their own separate assembly devices, with a press operator supplying the rolls of printed material. The press advantageously provides a standardized product, namely rolls.

Preferably, the assembly device includes a plurality of folders, each folder preferably having at least one former. Preferably, a plurality of formers for each folder are provided, so that W-shaped or Z-shaped folds can be achieved. Alternately, the folders may be plow folders.

The assembly device permits collection of signatures to form a complex printed product without human intervention.

The present method for roll-to-roll printing can eliminate any static required for efficient operation. Additionally, because the folder causes most of the faults when a printing method operates at high speeds, the separation of the folder from the roll-to-roll printing results in more efficient printing. The present invention also allows for more efficient on-the-fly changes because there are fewer mechanisms through which the printed material passes. Moreover, since the printed product winds up on a roll, storage of the material is facilitated.

The present invention also provides a method for printing comprising the steps of passing a web of material through a printing unit of a printing press so as to form a printed roll, slitting the printed web by a slitter so as to form a plurality of ribbons, winding the ribbons into at least one roll, and assembling printed products from the ribbons by folding and cutting the ribbons in a folder.

The slitting of the printed web provides the advantage of allowing more flexibility in combining images to form a document. Preferably, the method may include organizing the rolls of printed materials using identifications on the printed material, for example a specific text section which can be read through an optical character recognition (OCR) device or any other vision system. The identifications provide the advantage of efficient assembly of the rolls of printed material and of allowing ribbons from differing rolls of printed material to be assembled efficiently at a later date. Moreover, rolls may be created for specific printing purposes, for example, customized inserts based on geography or professions. The rolls can then be provided to the assembly devices to create customized printed products.

Preferably, the method includes printing a multi-color image to the printable material by four printing units. The printing units may be lithographic offset printing units for printing black, magenta, cyan, and yellow, each unit including a plate cylinder and a blanket cylinder.

The method may further include utilizing the printing press to print using digital imaging, with the plate cylinder being capable of being digitally imaged, for example using a laser or electronic process. Preferably, the images can altered "on-the-fly" for each rotation of the plate cylinder as the printing press is printing. Inspection of the actual products being printed can be provided by vision system. A processor can be connected to the digital imaging system. Data relating to the images printed on each roll can be stored in a database accessible by the processor. The processor also preferably controls the other sections of the printing apparatus, and can provide for proper selection of particular printed rolls to be arranged on unwinding devices of the assembly device. Thus finished products can be arranged as desired, with the processor functioning as a selection device.

By providing for digital imaging and on-the fly changes, the versatility of the printing process can be increased to accommodate a larger range of customer preferences, including customized products.

The printing press may print a variety of web widths. This allows for greater versatility in the printing process and the ability to accommodate a larger range of customer preferences.

The assembly device advantageously may provide for collecting signatures in a saddle fashion, the signatures having been created in a plurality of folders which feed a saddle conveyor. Advantageously, saddles of the conveyor in the assembly device eliminate the need for handling or gripping of signatures, one of the major fault makers of present bindery systems. The saddles may move in-line or angularly to the direction of web travel.

The assembly device also may provide for collecting signatures in movable pockets, which may move in-line or angularly to the direction of the signatures exiting the folders. The pockets collect a plurality of products so as to form larger finished products. Preferably, the pockets function to collate the products. Advantageously, the pocket conveyor located in the assembly device removes the need to grip or handle the signatures.

Prior art devices typically output the signatures to a stack, where the signatures would have to be separated and collected, for example in a bindery using hoppers, in order to form finished products such as books. Advantageously, with the present invention, no signature stacks have to be formed, and no removal of signatures from a stack is necessary.

Preferably, the method may further include storing rolls in at least one roll storage unit. The rolls may be of unprinted, pre-printed or printed material. The storage units provides more stable and efficient storage than signature storage, where edges and sheets can be more easily damaged. The printed rolls are less sensitive to damage than signatures.

Moreover, using the slitter and/or on-the-fly changes of images being printed, the printed rolls can be grouped or stored with specific characteristics. For example, in printing a particular magazine, a number of generic rolls to be printed, as well as one roll specifically with articles and advertising for a certain profession, such as doctors, and a second roll for another profession, such as teachers. The printed rolls can then be grouped on the unwinding devices of the assembly device, so that magazines for doctors using the generic rolls and the roll for doctors are formed, and then magazines for teachers are created using the generic rolls and the second roll for teachers. Labels or addresses from a database accessible by the processor can be printed on the products as well.

The processor also can store in the database the location of different individual images on each specific roll, so that when the printed products are placed on the unwinding rolls of the assembly machine, the individual images can be assembled as desired.

Each element of the printing device, including the roll storage units, the print form or plate cylinders, the vision system, and the assembly device can be connected via a LAN, for example, to the processor.

The method for printing may further include storing the rolls of printable material in an automated buffer. The automated buffer may then transfer a plurality of rolls to unwinding devices of the assembly device. In so doing, the automated buffer, which is controlled by the processor, may sort and organize the printed rolls using an identification attached to or part of the rolls. The automated buffer provides the advantage of greater automation in the printing method. Moreover, when used in conjunction with the identification, for example a bar code, the products may be printed and assembled with the most efficient allocation of labor and materials.

The winding devices of the press onto which the printed rolls are wound preferably have cutting devices and a guide device so that the ribbon being wound can be cut so that a finished roll is formed. The ribbon still exiting the printer can then be fed to a new winding device to start a new roll.

Once transferred to the unwinding devices of the assembly device, the printed ribbons or web may be cut by a cutting device, e.g., a retractable knife, into signatures. The cut may be a double or single clean cut.

Preferably, the method may further include requisition of a printing supply according to a customer pre-order. The pre-order may specify quantitative, e.g., the number of products required, as well as qualitative, e.g., the type of paper, criteria for the final product. By requisitioning the printing supplies at an early date, subsequent printing is more cost effective, e.g., the materials can be transmitted in bulk, and more efficient, e.g., there is no lag while waiting for materials.

The method advantageously may further include changing the roll-to-roll printing press pursuant to a customer order. For example, the image printed to the printable material, specifications regarding paper size and quality, and the location of the slits may be changed. This allows for greater versatility in the printing process and the ability to accommodate a larger range of customer preferences.

Preferably, the method may further include distribution of a final product to a customer. Labeling, sorting, and assembling the product produced by the folder may form the final product. Advantageously, the separation of the labeling, sorting, and assembling from the printing press and folder allows changes to be made to the printing press without interrupting the distribution to the customer.

BRIEF DESCRIPTION OF THE DRAWINGS

A preferred embodiment of the present invention is described below by reference to the following drawings, in which.

DETAILED DESCRIPTION

Figure 1:
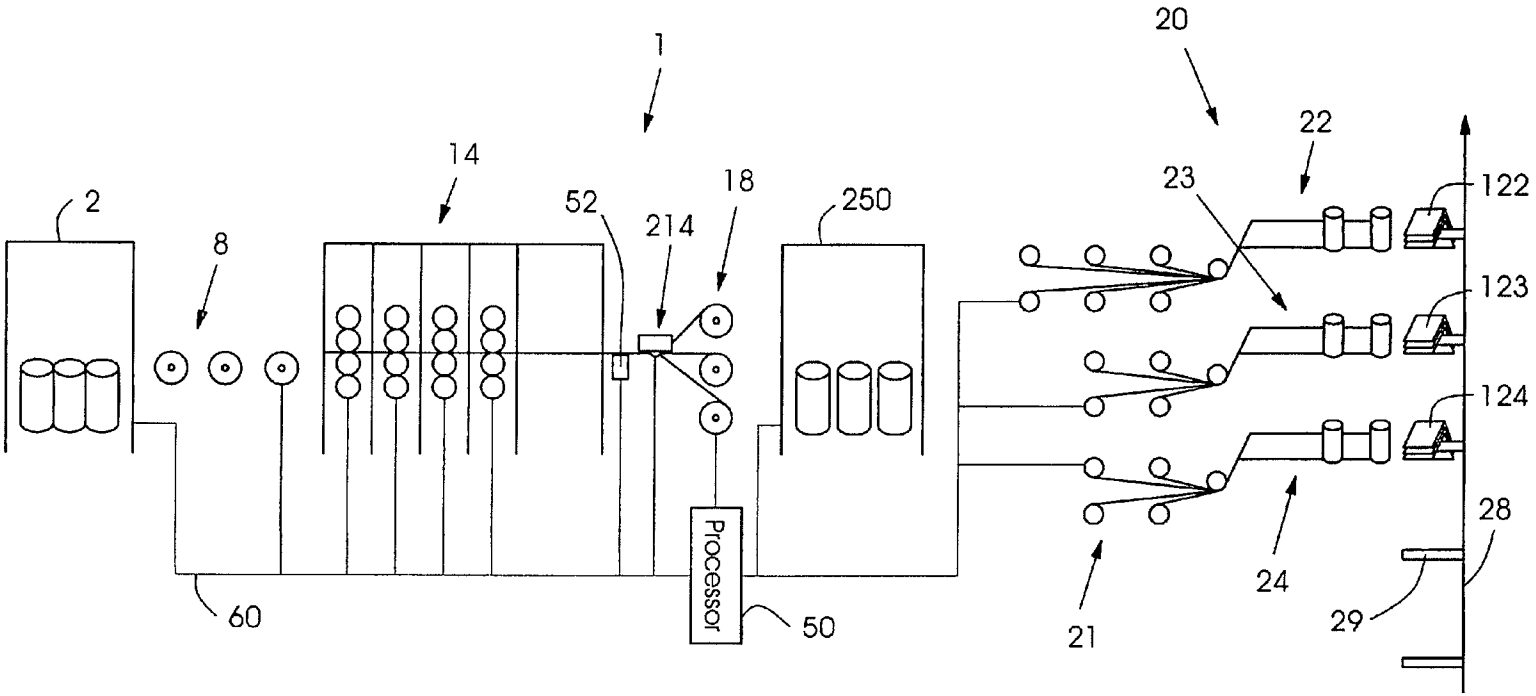
FIG. 1 shows an overview of the printing device of the present invention.

FIG. 1 shows an overview of the printing device 1 of the present invention. Printing device 1 includes an unprinted roll storage device 2, from which unprinted rolls of material 8, such as paper can be automatically transferred to a roll-to-roll printing press 14. The resulting printed rolls 18, which can be narrower than the unprinted rolls depending on a setting in a slitter or slitting device 214, are then transported, preferably automatically, to a roll storage device 250. An assembly device 20, which may be located in the same building as the printing press, or which may be located in another building, is used to assemble the printed rolls 18. Preferably, the rolls 18 in storage device 250 are sent automatically to roll unwinding devices 21 of assembly device 20 as a function of a desired final product format. The rolls are then unwound through one of a plurality of folders 22, 23, 24, each of which has a former board and a cutting device for cutting the webs from the unwound printed rolls into signatures 122, 123, 124, respectively. A conveyor 28, having for example saddles 29, can collect the signatures into a final printed product.

As can be seen from FIG. 1, the present device permits that printed products be assembled without complicated folding devices on the press creating signatures. The present device also permits a wide variety and format of printed products. A single unprinted roll of material can be slit into different width ribbons, which then can be assembled by the assembly device as desired. The entire electro-mechanical reliability and the productivity of the printing device can be improved.

The present device 1 also includes a processor 50 connected via a LAN 60 to automated storage devices 2 and 250, to plate cylinders or image cylinders of the print units of printing press 14, to a vision inspection device 52 for the web, to the slitter 214, to winding devices for the printed rolls 18, and to the assembly device 20. The processor 50, which can be for example an processor manufactured by the INTEL CORPORATION, can receive information regarding the size of rolls in storage device 2, control an automated transfer of the rolls to the press 14, control the images printed by the printing press 14 (including on-the-fly changes which vary the image with each rotation of the image cylinder), control the slitting of the web, and control the cutting of the web to form the printed rolls 18. The location of printed images on each printed roll 18 can be stored in a database accessible by the processor 50. The processor 50 also controls the automated transfer of the printed rolls 18 to the buffer 250 and to the unwinding rolls 21 of the assembly device 20, for example through robotic arms. The feeding of the printed rolls through the folders 22, 23, 24 can also be controlled, as can the folding which is accomplished by the folders, thus allowing desired printed products to be output to conveyor 28.

Figure 2:
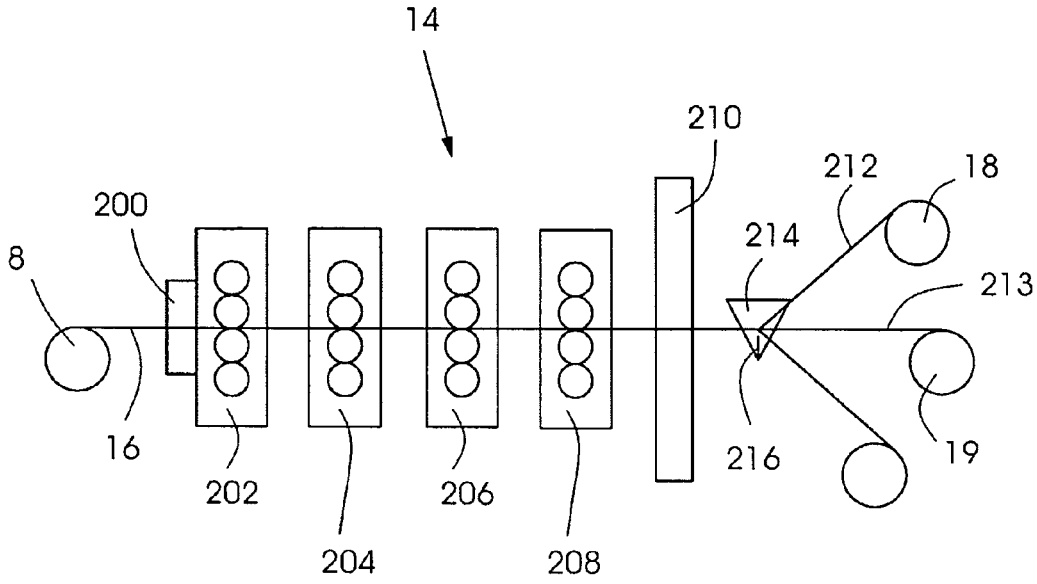
FIG. 2 shows a side view of the roll-to-roll printing press of the printing device according to FIG. 1.

FIG. 2 shows more details of the roll-to-roll printing press 14 of FIG. 1 printing a web 16. An input area 200 accepts the web 16 of unprinted material, e.g., paper, that is unwound from the roll 8 of material. The printing press 14 prints a multi-color image to the web 16 of material by four printing units 202, 204, 206, 208, which may be for example lithographic offset printing units for printing black, magenta, cyan, and yellow. Next, the printing press 14 dries the web 16 of printed material in a drying unit 210. After the drying unit 210, the printing press 14 selectively slits the web 16 of material into at least two ribbons 212, 213 using of a slitting device 214. The slitting device 214 may slit the web 16 of material by using a slitter 216, which slits the web 16 in-line to the direction of travel of the web 16 of material, as will be described in more detail with reference to FIG. 5. The slitting device 214 may sort the ribbon 212 and may wind the ribbon 212 into a plurality of rolls of printed material 18, 19. The plurality of rolls of printed material 18, 19 may then be transferred to the roll storage unit 250 of FIG. 1. If desired, the printing units 202, 204, 206, 208 may include digital imaging units. Additionally, the operator may set the printing units 202, 204, 206, 208 to print on different sized webs. Also, if desired, the operator may make on-the-fly changes, so that for example with each rotation of the printing cylinders a new image is printed.

The winding devices for rolls 18 include a cutting device for severing the web when a roll 18, 19 is complete, and can also include a feed device for feeding the ribbon exiting the press 14 to another winding device. The cutting device can be controlled by the processor 50.

Figure 3:
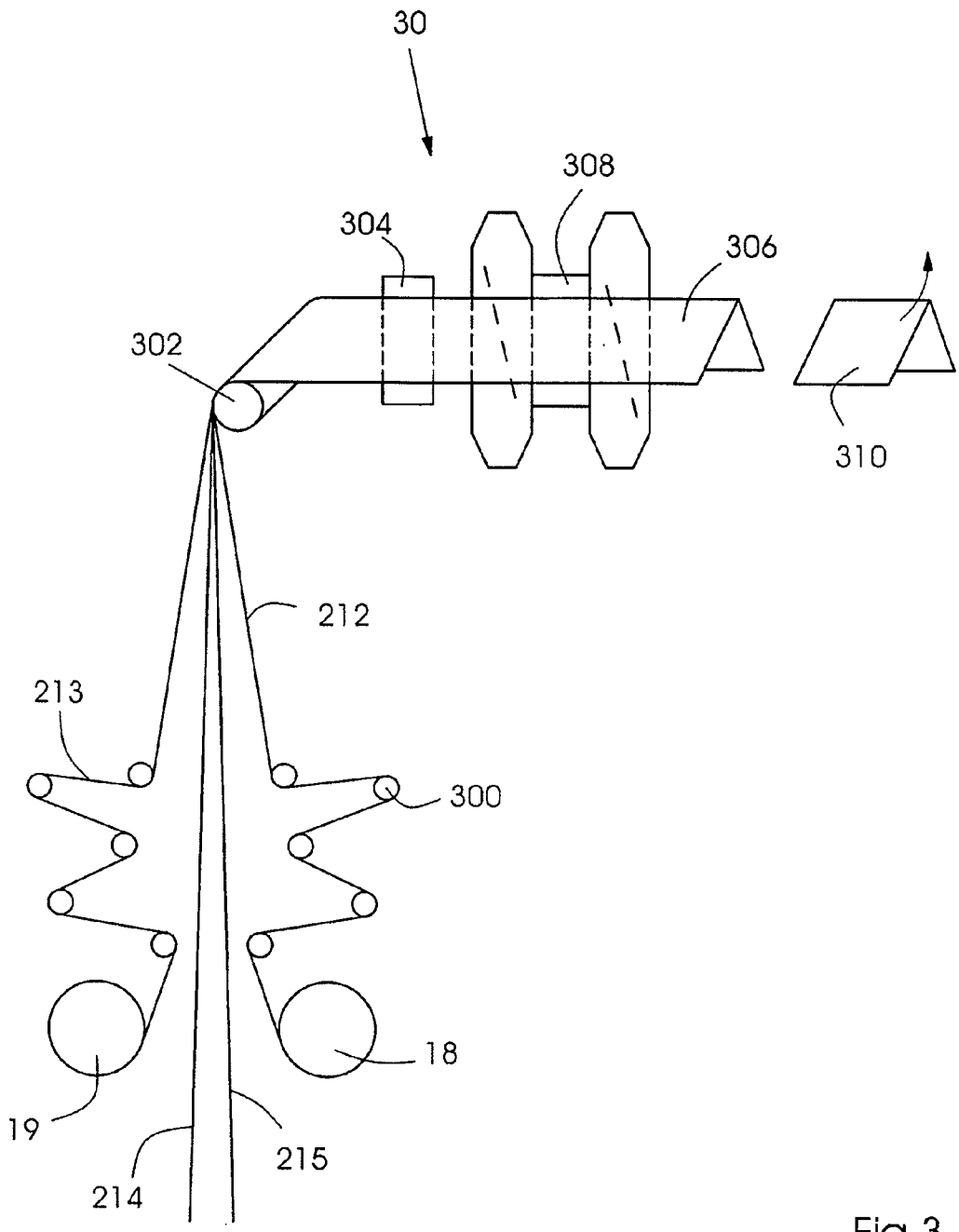
FIG. 3 shows a saddle-type embodiment of a folder used in the assembly device of FIG. 1.

FIG. 3 shows a side view of one embodiment of a folder 30 to be used as one of the folders in the assembly device 20. Ribbons 212, 213, 214, 215 are unwound from the rolls 18, 19, etc., aided by a plurality of rollers 300 which supply sufficient conditioning and tension, to send the ribbons 212, 213, 214, 215 over a former or former board 302. The former 302 and a plurality of nips 304 fold the at least one ribbon 212 so that the folder 30 may cut the at least one ribbon 212 into an at least one ribbon portion 306 by use of a ribbon cutting device 308, e.g., a retractable knife. Preferably the cutting device includes two sets of cutting blades, one cutting first set of perforations and the second fully severing the web into signatures 310. The assembly device 20 may then collect the signatures using a saddle conveyor 28 (FIG. 1) having saddles 29, which are timed to the cut and move in line or angularly (preferably perpendicularly) to the direction of the signatures exiting the folders.

Figure 4:
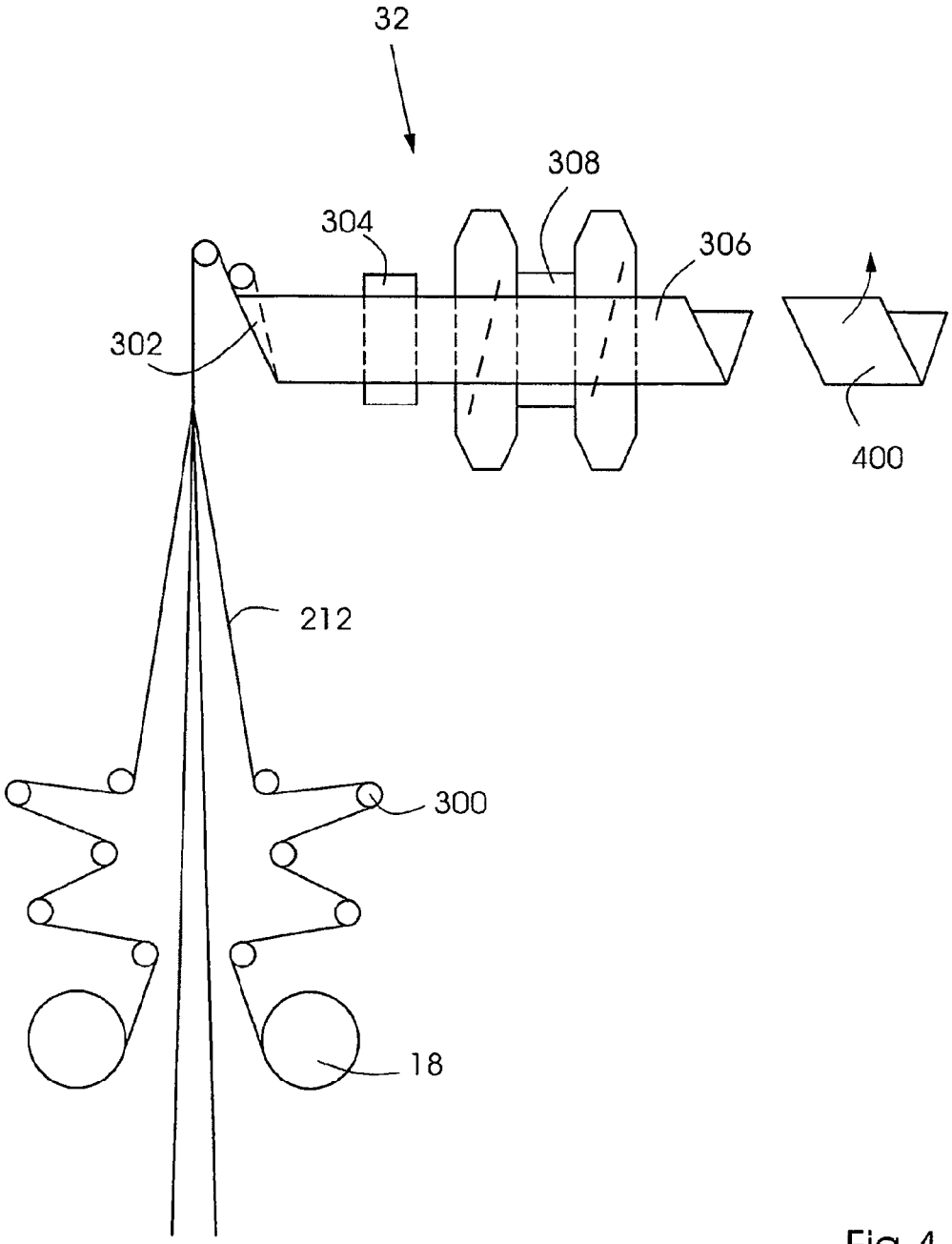
FIG. 4 shows a pocket-type embodiment of a folder used in the assembly device of FIG. 1.

FIG. 4 shows a side view of an alternate embodiment of a folder 32 to be used in assembly device 20. The at least one ribbon 212, is unwound from the roll 18 aided by the rollers 300, which supply sufficient conditioning and tension, to send the at least one ribbon 212 to the former 302. The former 302 and the nips 304 fold the at least one ribbon 212 so that the folder 30 may cut the at least one ribbon 212 into the at least one ribbon portion 306 by use of the ribbon cutting device 308, e.g., a retractable knife. The folder 30 may then collect the at least signature 306 by use of a plurality of pockets 400, which are timed to the cut and preferably move perpendicular or angularly to the direction of the printed material.

Figure 5:
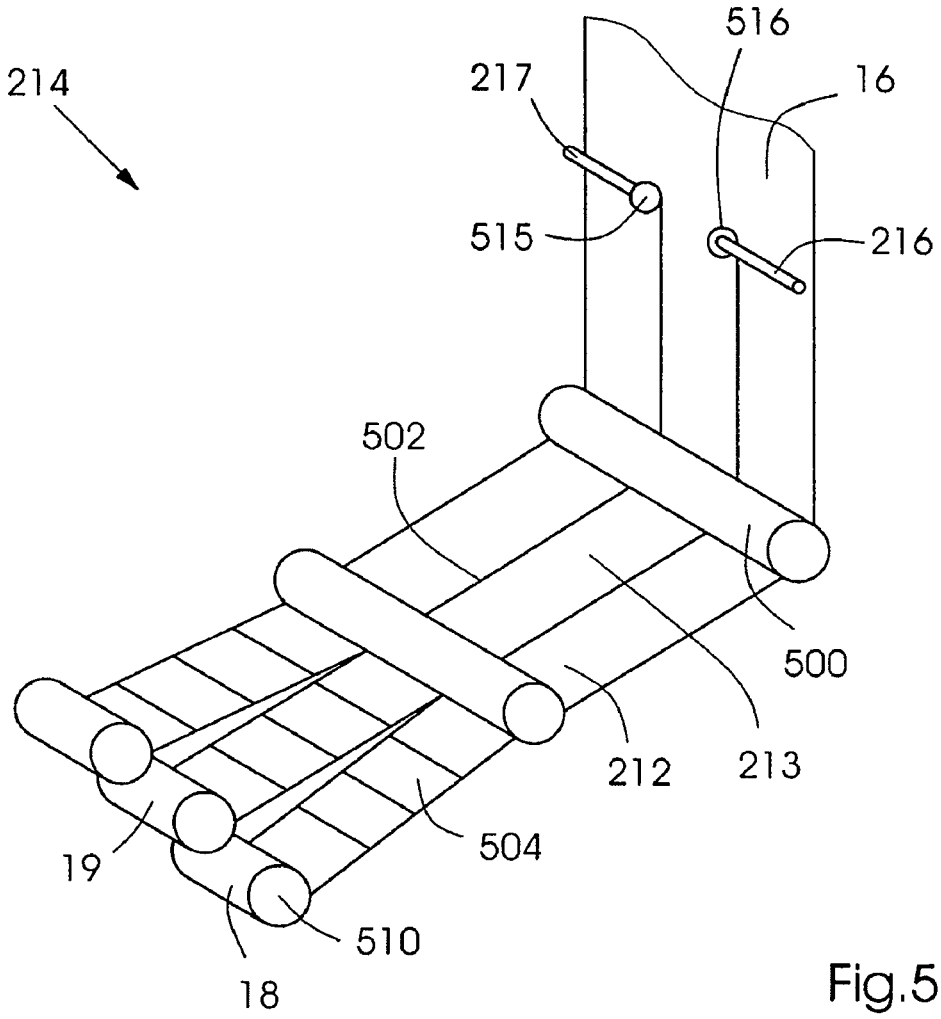
FIG. 5 shows a perspective view of the slitting device of FIG. 2.

FIG. 5 shows a perspective view of the slitting device 214, which includes the slitter 216. A plurality of guide rolls 500, for example two, may pass the web 16 through the slitting device 214 and guide the ribbons 212, 213 to a plurality of rollers 510, for example three, where the ribbons 212, 213 are wound into rolls 18, 19. While moving through the slitting device 214, the slitters 216, 217 cut the web 16 into the ribbons 212, 213, for example three, by a plurality of knives 515, 516, e.g., retractable knives. The line of the cut is in-line to the direction of travel of the web 16 and corresponds to a border 502 of a plurality of page images 504. The page images 504, which correspond to a page of the final product, are arranged head-to-toe on each ribbon 212. By forming the ribbons 212, 213, greater flexibility in combining the page images 504 in the assembly device 20 is provided, e.g., the page images 504 can be folded to foam the printed product in a variety of ways. The knives 515, 516 may be selectively engageable and axially movable, so that different sized ribbons can be created.

Figure 6:
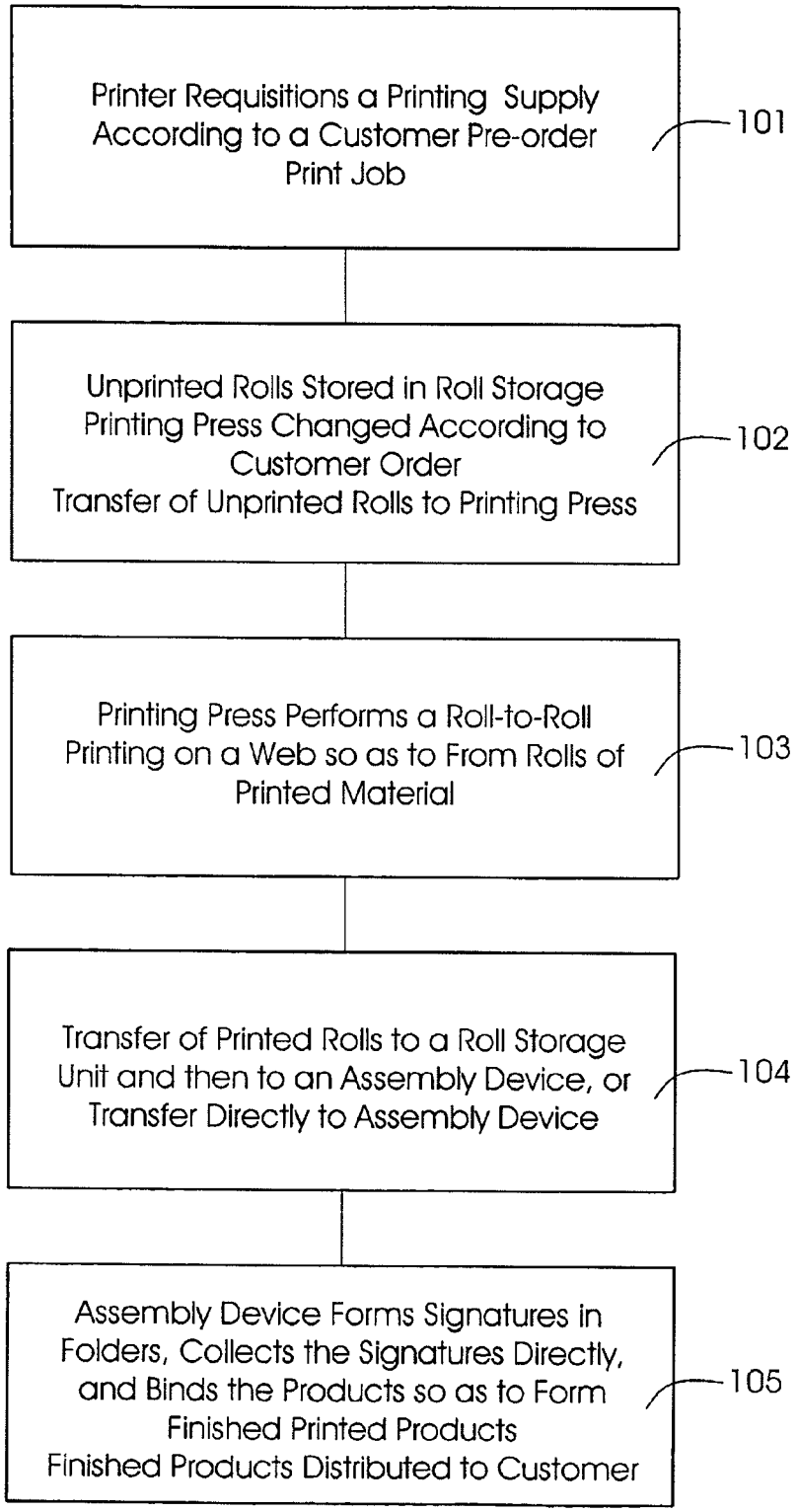
FIG. 6 shows a flow chart of a roll-to-roll printing and assembly method according to the present invention.

FIG. 6 shows a five-step flow chart of the roll-to-roll method of printing.

In step 101, a printer may requisition a printing supply, e.g., amount of paper, according to a customer pre-order.

In step 102, identifications may be attached to a plurality of rolls 8 (FIG. 2) of unprinted material, e.g., paper, so that a plurality of rolls of unprinted material, possibly of differing widths, may be sorted. An automated buffer may store the rolls 8 of unprinted material in the roll storage unit 2 of FIG. 1. A printing press 14, also shown in FIG. 2, may be prepared, e.g., the plate cylinder is pre-imaged by a laser or newly-imaged plates are provided or a digital imaging device with on-the-fly change capability is programmed, according to a customer order. Next, the rolls of unprinted material may be transferred to the printing press, for example manually or by a robotic arm.

In step 103, a roll-to-roll printing of a web of material on the printing press 14 so as to form the rolls 18 of printed material is performed as shown in FIG. 2. In so doing, the printing press 14 unwinds the rolls 8 of unprinted material, prints an image, may dry the printed material, and may slit the printed material as shown in FIG. 5. The web or ribbons are then wound so as to form rolls 18 of printed material, as shown in FIG. 2. The printing press 14 may print webs of various widths. The printed rolls may vary according to images altered using a digital imaging method during printing.

In step 104, the rolls 18 of printed material may be transferred, e.g., manually and/or using a transport device such as a vehicle, to a roll storage unit 250 as shown in FIG. 1. From the roll storage unit 250, the rolls 18 of printed material may be transferred, preferably automatically, to assembly device 20 as shown in FIG. 1. Alternately, rolls 18 may be transported to a plurality of assembly devices in different locations. The roll storage unit 250 preferably includes an automated buffer, which may then sort and organize the rolls of printed material and automatically transfer the rolls 18 of printed material to the assembly device 20.

In step 105, the assembly device 20 assembles the printed products from the rolls 18 of printed material by folding and cutting the printed material in the folders 22, 23, 24. The resulting signatures are collected to form a finished multi-page printed product. The printed product may be labeled and distributed to a customer.

The folders preferably each include at least one former board. Alternately, the folders may be plow folders. The ribbons from the unwinding devices 21 traveling through a folder also may be guided over more than one former of the folder, so that various folds such as W folds can be achieved. The ribbons also can be guided over only one side of the former, so that no fold is provided.

The assembly device preferably includes a large number of unwinding devices, most preferably more than four, to permit a large variety of product assembly possibilities.

Because the rolls can be identified by, for example, an OCR device, the entire process of placing printed rolls on the unwinding devices in a desired manner can be automated. A processor or computer can be provided to provide the control for the placement of the printed rolls in the assembly device.

What is claimed is:

1. A method for printing comprising the steps of:

printing a web of material so as to define a printed web;

slitting the web into at least two ribbons;

winding the printed web ribbons onto at least two rolls;

cutting the printed web ribbons so as to define at least two printed rolls;

storing a plurality of printed rolls including the at least two printed rolls in an automated buffer;

controlling the automated buffer by a processor by selecting the at least two printed rolls from the automated buffer for arrangement on unwinding devices of an assembly device for processing into a finished printed product formed from a plurality of signatures in the assembly device;

transporting the at least two printed rolls in rolled form from the automated buffer to the unwinding devices of the assembly device; and processing the at least two printed rolls together in the assembly device to form the finished printed product, the processing includes forming the plurality of signatures.

2. The method as reciting in claim 1 further comprising inspecting the printed web with a vision system to obtain data relating to images on the printed web, the controlling the automated buffer by the processor using the data relating to the images.

3. The method as recited in claim 1 wherein the processing includes unwinding the at least two printed rolls into unwound printed webs, longitudinally folding the unwounded printed together, and cutting the unwound longitudinally folded printed webs together to form the plurality of signatures.

4. The method as recited in claim 1 wherein the processing includes assembling the at least two printed rolls with at least one additional printed roll to form the finished printed product.

5. The method as recited in claim 4 wherein the at least one additional printed roll includes advertising for a specific group of people.

6. The method as recited in claim 1 further comprising attaching a code to each of the at least two printed rolls, the processing including processing the at least two printed rolls together in the assembly device to form the finished printed product as a function of the code.

7. The method as recited in claim 1 further comprising storing data relating to the images printed on each roll in a database accessible by the processor.

8. The method as recited in claim 7 further comprising storing, by the processor, locations of different individual images on each specific roll in the database so that when the at least two printed rolls are placed on the unwinding rolls of the assembly machine the individual images are assembled as desired.

9. The method as recited in claim 1 further comprising controlling the automated buffer, by the processor, to sort and organize the at least two printed rolls an identification attached to or part of each of the at least two printed rolls.

10. The method as recited in claim 1 further comprising receiving, by the processor, information regarding a size of each of at least one unprinted roll in a storage device and controlling, by the processor, an automated transfer of the at least one unprinted roll to a printing press for printing a web of material so as to define the printed web.

* * * * *